US005934268A

United States Patent [19]

Onocki

[11] Patent Number: 5,934,268

[45] Date of Patent: Aug. 10, 1999

[54] CATALYTIC FIREPLACE INSERT

[75] Inventor: Theodore J. Onocki, Florence, Ala.

[73] Assignee: Martin Industries, Inc., Florence, Ala.

[21] Appl. No.: 09/040,872

[22] Filed: Mar. 18, 1998

[51] Int. Cl.[6] ..... F24C 3/00

[52] U.S. Cl. ..... 126/512; 126/500

[58] Field of Search ..... 126/512, 500, 126/307 R, 312; 431/125; 110/203, 205, 211; 248/200.1, 201, 351, 354.1

[56] References Cited

U.S. PATENT DOCUMENTS

| | | | |
|---|---|---|---|
| 1,621,135 | 3/1927 | Sala . | |
| 1,703,459 | 2/1929 | Sala . | |
| 1,726,000 | 4/1929 | Sala . | |
| 1,884,746 | 10/1932 | Kline et al. . | |
| 3,111,123 | 11/1963 | Fort | 126/137 |
| 3,139,882 | 7/1964 | White | 126/137 |
| 3,224,429 | 12/1965 | Quittner | 126/202 |
| 3,641,922 | 2/1972 | Nachazel et al. | 99/340 |
| 3,834,370 | 9/1974 | Nelson | 126/137 |
| 4,117,825 | 10/1978 | Robertson | 126/29 |
| 4,194,490 | 3/1980 | Crnkovic . | |
| 4,328,785 | 5/1982 | Kishiyama | 126/165 |
| 4,373,508 | 2/1983 | Northcraft | 126/298 |
| 4,553,527 | 11/1985 | Albersen | 126/58 |
| 4,688,548 | 8/1987 | Stoughton . | |
| 4,691,686 | 9/1987 | Alvarez . | |
| 4,793,322 | 12/1988 | Shimek et al. . | |
| 4,919,120 | 4/1990 | Horikoshi et al. . | |
| 4,932,391 | 6/1990 | Bierdeman | 126/30 |
| 5,081,981 | 1/1992 | Beal . | |
| 5,127,392 | 7/1992 | Mizuno et al. . | |
| 5,139,011 | 8/1992 | Moon . | |
| 5,180,126 | 1/1993 | Bennett | 248/99 |
| 5,553,603 | 9/1996 | Barudi et al. . | |
| 5,678,534 | 10/1997 | Fleming . | |
| 5,797,234 | 8/1998 | Thedorou | 52/578 |
| 5,826,847 | 10/1998 | Warner et al. | 248/354.1 |

FOREIGN PATENT DOCUMENTS

| | | |
|---|---|---|
| 610285 | 2/1935 | Germany . |
| 428393 | 5/1935 | United Kingdom . |
| 571924 | 9/1945 | United Kingdom . |
| 661919 | 11/1951 | United Kingdom . |
| 681840 | 10/1952 | United Kingdom . |
| 2087542 | 5/1982 | United Kingdom . |
| 2203532 | 10/1988 | United Kingdom . |
| 2216252 | 10/1989 | United Kingdom . |
| 2261942 | 6/1993 | United Kingdom . |

*Primary Examiner*—Ira S. Lazarus
*Assistant Examiner*—Donna Mann
*Attorney, Agent, or Firm*—Shook, Hardy & Bacon L.L.P.

[57] ABSTRACT

A catalytic insert for an existing fireplace structure includes a frame for carrying a catalyst member. The frame is disposed in the fireplace structure at a vertically elevated position such that an upper chamber is formed in the structure, and such that at least a portion of the combustion products generated in the fireplace flow into the chamber through the catalyst member and exit the chamber into the room in which the fireplace structure is located. A support member extends from the frame to the fireplace structure bottom wall. The support member provides the main source of support of the frame within the fireplace structure. The frame and support member are adapted to be positionable in an existing fireplace structure to allow catalytic reaction of combustion products generated in the fireplace structure. The frame of the insert can also be adjustable to conform to multiple configurations of the fireplace structure.

19 Claims, 3 Drawing Sheets

Fig. 7.
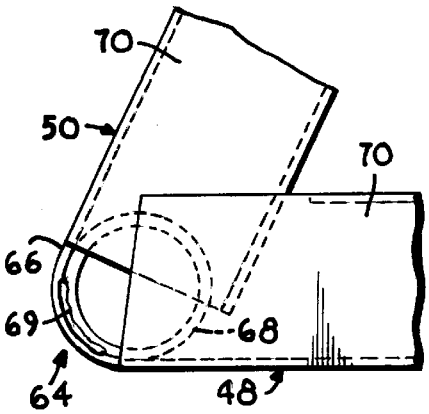
Fig. 8.
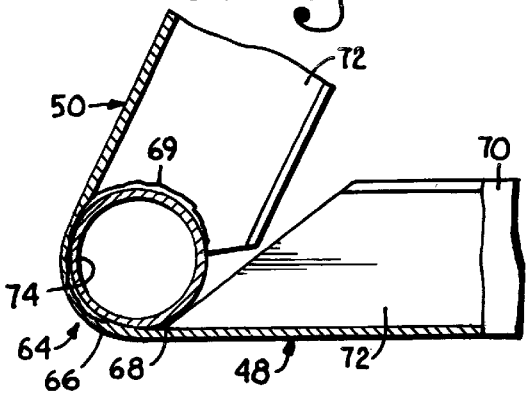
Fig. 9.
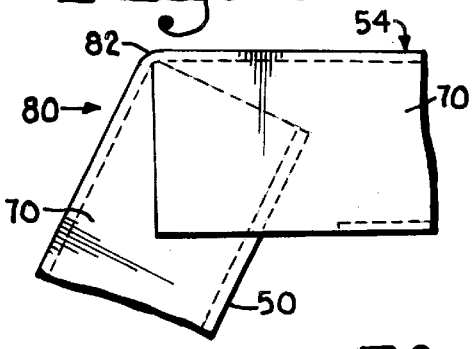
Fig. 10.
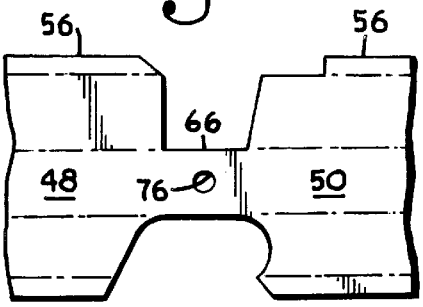
Fig. 11.
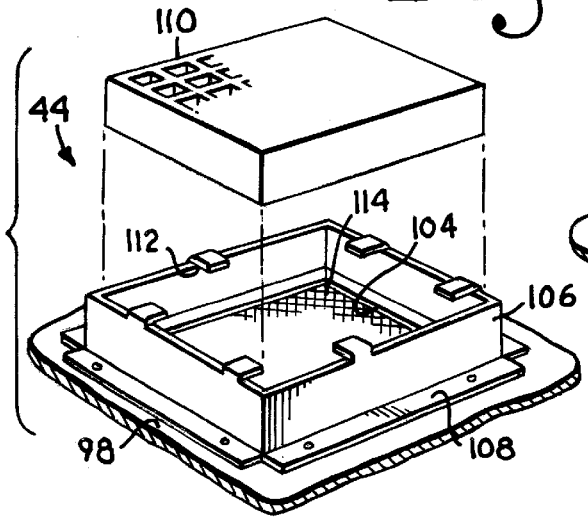
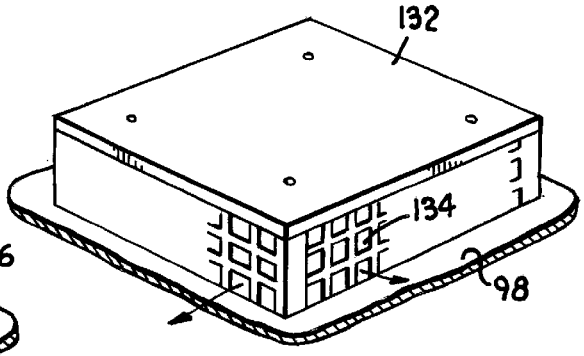
Fig. 12.

CATALYTIC FIREPLACE INSERT

STATEMENT REGARDING FEDERALLY-SPONSORED RESEARCH OR DEVELOPMENT

Not applicable.

CROSS REFERENCE TO RELATED APPLICATIONS

Not applicable.

BACKGROUND OF THE INVENTION

This invention relates generally to a catalytic insert for an existing fireplace, and, more particularly, to an insert that is adjustable to numerous different configurations of existing fireplaces.

For a number of years, homeowners have been replacing existing wood-burning fireplaces with gas-burning fireplaces. In particular, these fireplaces utilize artificial logs (for instance, ceramic logs) that have a gas burner outlet below the logs to simulate burning firewood. Additionally, many homes are constructed with dedicated gas-burning fireplaces. In order to operate a gas-type fireplace that has been converted from an existing wood-burning fireplace, it is necessary that the flue be open when the gas burner is operating. This is to ensure that a majority of harmful gases (for instance, carbon monoxide) generated by the burner are vented outside the room in which the fireplace is located. Additionally, dedicated gas-burning fireplaces in homes usually also will have a flue for venting harmful gases to the exterior of the home. Where an existing wood-burning fireplace is converted to a commercially available clean-burning gas-type fireplace, the homeowner making the conversion cannot be assured that the flue draw of the fireplace is adequate enough to vent sufficient levels of harmful gases to the atmosphere. Therefore, there is at least the potential that harmful gases could be exiting the open face of the fireplace and entering the room. An additional disadvantage associated with gas-burning fireplaces that utilize a flue is that oftentimes substantial amounts of heat are lost during the venting of gases to the atmosphere. Furthermore, the insulation characteristics of the home in which the fireplace is located can sometimes be affected by an open flue.

There are also commercially available clean-burning gas fireplaces that can be installed and that allow the closure of the flue. These units are rated to return an acceptable level of harmful gases to a room with the flue closed. However, such clean-burning fireplaces can oftentimes be misinstalled or improperly adjusted such that unacceptable levels of harmful gases enter the room. Further, although such clean-burning units may meet safety standards by allowing only a certain level of harmful gases into the room, oftentimes it may be desirable to further decrease the level of harmful gases below set safety standards. Still further, sometimes homeowners utilize wood chips in clean-burning units. In such instances, the level of harmful gases may rise above established safety levels.

Therefore, a retrofit insert structure is needed which will help alleviate the problems with the prior art fireplace structures discussed above.

SUMMARY OF THE INVENTION

Accordingly, it is an object of the invention to provide a fireplace insert which contains a catalyst member which increases the neutralization of harmful gases generated in a fireplace so as to increase the return of safe combustion gases to the room in which the fireplace structure is located.

Another object of the invention is to provide a catalytic fireplace insert that is adaptable to numerous different shapes and sizes of fireplace structures.

A further object of this invention is to provide a catalytic fireplace insert which does not require attachment to the side walls of the existing fireplace structure, but is generally freestanding upon the bottom surface of the fireplace.

A still further object of the present invention is to provide a catalytic fireplace insert which allows the closure of a fireplace flue so that heat generated in the fireplace structure is returned to the room in which the fireplace structure is located.

Accordingly, the present invention provides for a catalytic insert for an existing fireplace structure. The fireplace structure includes a top wall, a bottom wall, a rear wall, and a pair of side walls. The insert includes a frame carrying a catalyst member. The frame is disposed in the fireplace structure at a vertically elevated position, such that an upper chamber is formed in the structure, and such that at least a portion of the combustion products generated in the fireplace flow into the chamber through the catalyst member and exit the chamber into the room in which the fireplace structure is located. The insert includes at least one support extending from the frame to the fireplace structure bottom wall. The support member provides the main source of support of the frame within the fireplace structure. The frame and support are adapted to be positioned in an existing fireplace structure to allow catalytic reaction of combustion products generated in the fireplace.

The invention further includes an adjustable fireplace insert for positioning at an elevated location in a fireplace. The insert includes a plurality of elongated edge segments with at least two of the edge segments being connected together such that one of the segments can be adjusted with respect to the other segment. Further, at least one of the edge segments is also adjustable in length. An adjustable catalyst support plate is attached to the elongated edge segments and supports a catalyst member.

Additional objects, advantages, and novel features of the invention will be set forth in part in the description which follows, and in part will become apparent to those skilled in the art upon examination of the following, or may be learned by practice of the invention.

BRIEF DESCRIPTION OF THE DRAWINGS

In the accompanying drawings which form a part of this specification and are to be read in conjunction therewith and in which like reference numerals are used to indicate like parts in the various views:

FIG. 7 is an enlarged view of the area designated by the numeral 7 in FIG. 4 showing the front deformable joint structure between two adjacent edge segments of the fireplace insert;

FIG. 8 is a view similar to FIG. 7 with parts broken away and shown in cross section to reveal details of construction and, in particular, the lower flanges of the edge segments;

FIG. 9 is an enlarged view of the area shown by the numeral 9 in FIG. 4 showing the rear deformable joint between adjacent edge segment members;

FIG. 10 is a view of the front joint construction prior to folding of the edge segments into their channel shape;

FIG. 11 is a fragmentary, top perspective view of the attachment of a catalyst member to a top catalyst support panel, such construction allowing generally vertical flow of gases in the fireplace upwardly through the catalyst member; and FIG. 12 is a fragmentary, top perspective view similar to FIG. 11, but showing a different embodiment of a catalyst member, wherein the gases generated in the fireplace are turned in the catalyst member so as to exit the catalyst member in a generally horizontal fashion.

DETAILED DESCRIPTION OF THE PREFERRED EMBODIMENT

Figure 1:
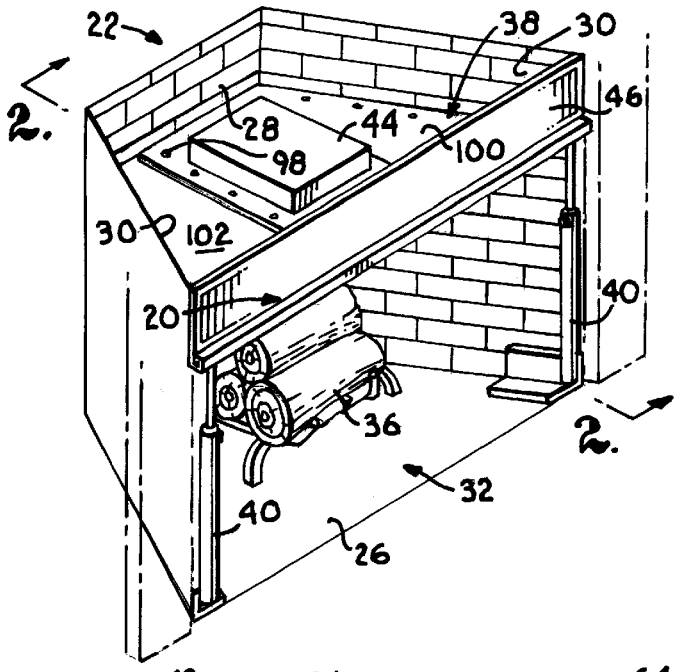
FIG. 1 is a top perspective view of an existing fireplace structure with the catalytic insert disposed therein and adjusted to the configuration of the existing fireplace.
Figure 2:
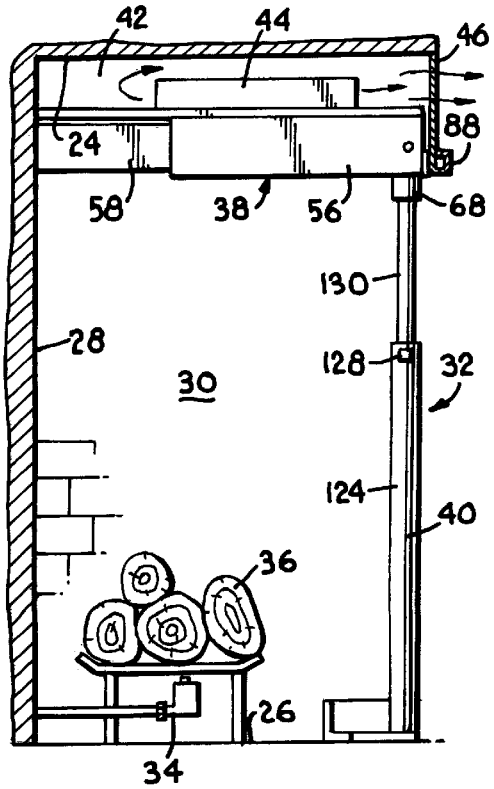
FIG. 2 is a cross-sectional view taken generally along line 2—2 of FIG. 1 and showing the flow of combustion gases through the catalyst member and into the room in which the fireplace structure is located.

Referring to the drawings in greater detail, and initially to FIGS. 1 and 2, a catalytic fireplace insert designated generally by the reference numeral 20 is shown. Insert 20 is positioned in an existing fireplace structure 22. Fireplace structure 22 includes top wall 24, bottom wall 26, rear wall 28, and a pair of side walls 30. Fireplace 22 has an open front 32 which is open to the room in which the fireplace is positioned and which allows the flow of heat from the fireplace into the room to which it is open. Located along bottom wall 26 is a gas burner structure 34 and ceramic logs 36. Burner 34 and logs 36 provide a visually appealing flame that heats the room.

Insert 20 includes a catalyst support frame 38 positioned at an elevated position within fireplace 22 and supported by a pair of support poles 40 which extend downwardly from frame 38 and rest upon bottom wall 26. Poles 40 are located adjacent the edges of open front 32, and are generally the sole support of frame 38. With reference to FIG. 2, a chamber 42 is formed between frame 38 and upper wall 24. Frame 38 is positioned such that gases flowing upwardly from burner 34 flow through a catalyst member 44 wherein they are reacted and neutralized, and thereafter flow outwardly into the room via a grate or screen 46.

With reference to FIGS. 3–6, the construction and adjustability of insert 20 is shown. Frame 38 includes four adjustable length edge segments 48, 50, 52, and 54. Each edge segment includes a large cross-sectional portion 56 and a small cross-sectional portion 58. Small portion 58 is telescopically received in large portion 56 in the manner shown in FIG. 6 so that the length of segments 48, 50, 52, and 54 can be varied by sliding small portion 58 within large portion 56. Portions 56 and 58 preferably have a C-shaped cross section which allows for ease of formation of the portions from a flat sheet of metal. A 1/32 inch clearance between members 56 and 58 has been found to be acceptable to allow a sliding action between the portions. Edge segments 48, 50, 52, and 54 can be held at a particular length by utilization of apertures 60 formed in small portions 58 and setscrews 62.

Figures 5, 6:
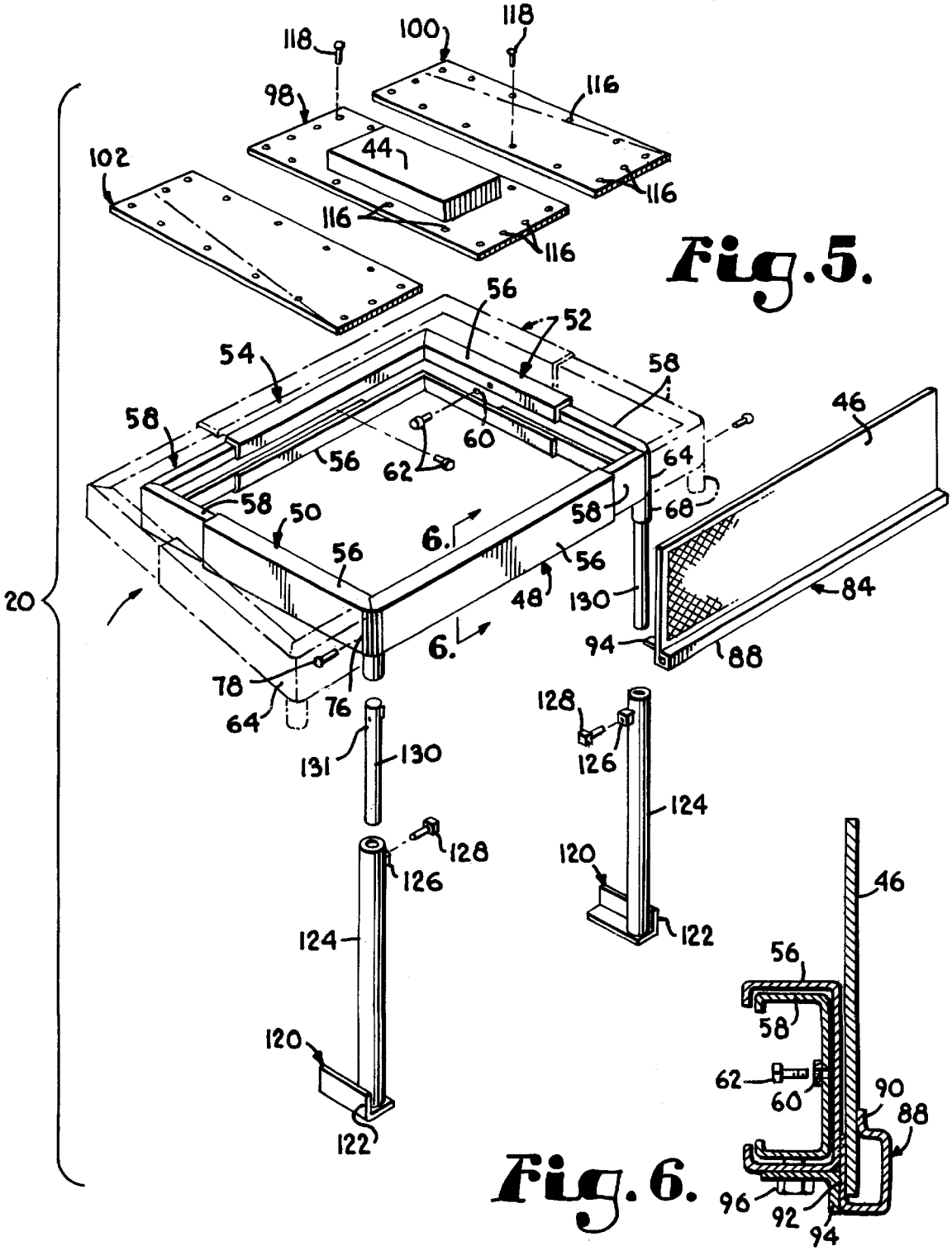
FIG. 5 is an exploded top perspective view of the catalytic insert with the adjustability of the elongated edge segments shown in phantom lines.
FIG. 6 is a cross section taken generally along line 6—6 of FIG. 5 and showing the telescoping relationship of an adjustable edge segment and the connection of the front fascia plate thereto.

Front edge segment 48 is attached to side edge segments 50 and 52 via a flexible adjustable joint 64, as is best shown in FIGS. 7 and 8. More specifically, joints 64 allow angular movement of segment 48 with respect to segments 50 and 52. Joint 64 utilizes a flexible bridge of material 66 to accomplish this movement. Bridge 66 deforms around an attachment bushing 68, as best shown in FIGS. 7 and 8. More specifically, cylindrical attaching bushing 68 is welded at its top and bottom along portions 69 of bridge 66, but bridge 66 can still be flexed around bushing 68 in such a manner that segments 50 and 52 can be moved or adjusted with respect to front segment 48. Upper horizontal flanges 70 of segments 48, 50, and 52 overlap upon one another as bridge 66 is bent around bushing 68, as best shown in FIG. 7. However, because bushing 68 is used to attach support poles 40, as will be more fully described below, it is necessary that lower flanges 72 of segments 48, 50, and 52 do not interfere with the interior receiving bore 74 of bushing 68, as best shown in FIG. 8. Thus, flanges 72 are cut accordingly to allow access to bushing 68. With reference to FIG. 10, the pattern used to form a joint 64 from a flat piece of material is shown. More specifically, bridge 66 extends between two flat pieces of material that are utilized to form segments 48 and 50. With reference to FIGS. 5 and 10, each bushing 68 and bridge 66 has aligned apertures 76 formed therein for receipt of a screw 78. Screw 78 is used to secure support poles 40 to frame 38, as will be more fully described below.

Rear segment 54 is attached to side segments 50 and 52 via rear joints 80. With reference to FIG. 9, rearjoints 80 are comprised of a flexible bridge section 82 which is integral with rear segment 54 and the respective adjacent side segment 50 or 52. Upper and lower flanges 70, 72 overlap upon one another as adjustment between segment 54 and segments 50 and 52 is obtained. Therefore, joints 80 allow angular movement of side segments 50 and 52 with respect to rear segment 54.

Figure 3:
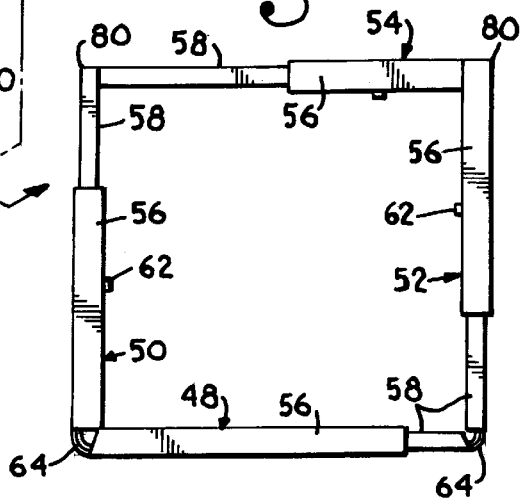
FIG. 3 is a top plan view of the fireplace insert prior to the catalyst supporting panels being attached, and prior to its formation to the interior of the fireplace structure.
Figure 4:
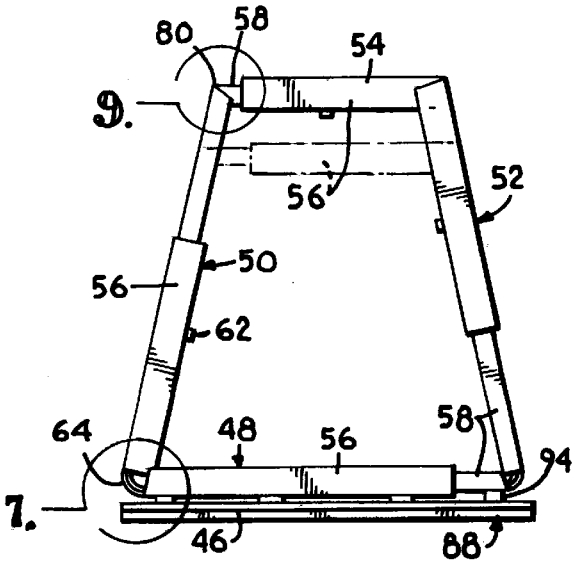
FIG. 4 is a view similar to FIG. 3 showing the elongated edge segments of the catalytic insert after having been conformed to the desired shape for insertion into the existing fireplace structure.

As best shown in FIGS. 3 and 4, adjustable segments 48, 50, 52, and 54 allow frame 38 to obtain various configurations that can conform to the rear wall 28, side walls 30, and front opening 32 of fireplace 22. In particular, by bending about joints 64 and 80 and adjusting the length of the relevant segments utilizing the telescoping arrangement, numerous different configurations can be accomplished. After a particular arrangement has been accomplished, the frame can be set in this desired arrangement by use of setscrews 62 which fix portions 56 and 58 of the respective segments with respect to one another.

With reference to FIG. 10, it is preferable to form portion 56 of segment 50 integrally with portion 56 of front segment 48. The integral connection forms a front joint 64. Additionally, it is preferable to integrally form portion 58 of side segment 52 with portion 58 of front segment 48 to also form an integral joint 64. Still further, it is preferable to integrally form portion 58 of side segment 50 with portion 58 of rear segment 54, and integrally form portion 56 of side segment 52 with portion 56 of rear segment 54 to form rear joints 80. Although joints 64 and 80 are shown formed utilizing an integral piece of flexible metal, other arrangements could also be suitable. For instance, a hinge utilizing a pin could be suitable, or further, a flexible material that is not integrally formed with the segments, but instead welded thereto, or interlocking joints could also be suitable.

With reference to FIGS. 5 and 6, a fascia plate assembly 84 is attached to front segment 48. Fascia plate assembly 84 includes a screen 46 and a screen holding bracket 88. Bracket 88 receives screen 46 in such a manner that the height of screen 46 within bracket 88 can be adjusted. More specifically, front arm 90 of bracket 88 is spring-biased toward rear arm 92 in such a manner that the screen 86 is pinched between the two arms. In this manner, screen 86 can be adjusted to a variety of heights and held therein due to the biasing between arms 90 and 92. Screen 46 and bracket 88 can be cut to the relevant size of open front 32 so as to generally match the length of front segment 48. Such adjustment in the length of screen 46 and bracket 88 can be accomplished with a tin snips or a hacksaw by a homeowner.

Bracket 88 is attached to front segment 48 utilizing L-shaped connecting flange 94 and screws 96. In particular, flange 94 is fixedly secured to bracket 88 by, for instance, welding, and screws 96 are disposed in apertures in flange 94 and front segment 48 to secure the bracket thereto, as best shown in FIG. 6. In this manner, after frame 38 has been adjusted to the size of fireplace 22, fascia plate assembly 84 can also be adjusted to cover the front opening of chamber 42.

Adjustable catalyst support plates or panels 98, 100 and 102 are utilized to extend between segments 48, 50, 52, and 54 to form chamber 42, and support catalyst member 44. More specifically, panel 98 is generally positioned in the center of the edge segments 48 and 54 and supports catalyst member 44. With reference to FIG. 11, panel 98 has an aperture 104 formed therein. Positioned on the upper surface of panel 98 is a catalyst support bracket 106. Bracket 106 is attached to plate 98, utilizing tabs 108 and any suitable attaching means such as rivets or screws. Bracket 106 generally surrounds solid catalyst 110 and holds it in position along the upper surface of panel 98 utilizing deformable projections 112. It may be necessary in certain instances to utilize a protective screen or grid 114 to cover aperture 104 and protect the catalyst from direct flame generated in the fireplace, although at other times such a screen may not be necessary.

Side panels 100 and 102 are conformed to the shape of frame 38 and to cover the remaining portions existing between panel 98 and the edge segments 50 and 52. In particular, panels 100 and 102 can be cut utilizing a tin snips or the like so as to overlap upon catalyst panel 98, and further, rest upon upper flanges 70 of the edge segments. As is apparent, more or less panels can be utilized dependent upon the formed configuration of frame 38. Once panels 98, 100, and 102 have been cut to a suitable size such that they match the desired shape of edge segments 48, 50, 52, and 54, they are attached to upper flanges 70 of the segments utilizing fasteners 118 (such as screws or rivets) positioned through apertures 116 formed in the panels. Additionally, panels 100 and 102 can be attached to panel 98 also utilizing fasteners 118 and apertures 116. Thus, in this manner, frame 38 can be formed so that upper chamber 42 is substantially blocked off from the rest of fireplace 22, and such that gases generated in the fireplace will flow upwardly through aperture 104 and catalyst 110 into chamber 42, and thereafter through screen 86 and into the room.

In addition to the use of fasteners 118 to attach panels 98, 100, and 102 to the edge segments, it has been found preferable to also utilize a suitable fireplace sealant or caulking (such as a silicate compound) between upper flanges 70 of the edge segments and the lower surface of the panels so as to form an airtight seal.

As described above, support poles 40 are utilized to support frame 38 at its elevated position within fireplace 22. Each pole 40 includes an L-shaped base 120 for positioning along bottom wall 26 of fireplace 22. Base 120 extends rearwardly into the fireplace and also has a flange portion 122 which rests against the respective side wall 30 of the fireplace. Fixedly attached to base 120 is a support tube 124. Tube 124 can be attached to base 120 in any suitable manner, for instance, welding. Welded onto the side of support tube 124 is a threaded nut 126 which receives a setscrew 128. Telescopically received in tube 124 is a further movable adjusting tube 130. Adjusting tube 130 can be set to a variety of heights by utilizing setscrew 128. The upper end of adjusting tube 130 is received in bore 74 of attachment bushing 68 to fixedly attach pole 40 to frame 38. The attachment of tube 130 to bushing 68 is accomplished by aligning apertures 76, and a threaded aperture 131 formed in tube 130 and thereafter, utilizing screw 78 to secure the parts together. Thus, as is apparent, pole 40 can be adjusted to hold frame 38 at a variety of heights above bottom wall 26 of fireplace 22 by utilizing setscrew 128. Additionally, base 120 can be conformed to rest against side walls 30 of fireplace 22 by rotating tube 124 within its respective tube 130 and fixing tube 124 with respect to tube 130 (and thus frame 38) by utilizing setscrew 128.

A suitable catalyst material for catalyst member 44 is a solid-type catalyst having a cross board or honeycomb-type configuration made of a ceramic or metal construction. In particular, one suitable type of catalyst is sold under the trademark VERSAGRID® available from Applied Ceramics, Inc., of Atlanta, Ga. The primary function of the catalyst is to complete the oxidation of the burning process. The result is clean safe exhaust made of excess air, carbon dioxide, and water vapor. A primary concern for indoor air quality is the conversion or oxidation of carbon monoxide to carbon dioxide. The type, quantity, and size of the catalyst can be chosen in a manner well-known in the art, to accomplish the desired oxidation.

With reference to FIG. 12, an alternative catalyst member 134 is shown. In this catalyst member, gases flow upwardly through aperture 104 and take a sharp turn prior to exiting into chamber 42. The grid structure of the catalyst accomplishes this turn and can aid the flow characteristics of the fireplace with the insert 20 therein. An upper plate 132 is utilized to secure alternative catalyst 134 to panel 98.

Insert 20 provides an easy, effective, and inexpensive structure that increases the oxidation of the gases generated in an existing fireplace structure 22 to increase the amount of combustion gases that are safe for recirculation into the room in which the fireplace is located. The adjustability of insert 20 allows it to conform to a variety of different sized fireplaces and applications. In particular, insert 20 can be sold as a kit having assembled but nonfixed edge segments 48, 50, 52, and 54, fascia plate assembly 84, adjustable expansion catalyst support plates 98, 100, and 102, and support poles 40. These parts can be made of a suitable heat-resistant metal. A homeowner purchasing such a kit would adjust the edge segments in such a manner so that they conform to the inside dimensions of the fireplace, and thereafter secure and cut the panels 98, 100, and 102 to the frame so that catalyst member 44 is positioned at a central location. Thereafter, frame 38 can be adjusted to a particular height above burner 34. Further, fascia plate assembly 84 can be adjusted and secured to frame 38 to cover the front opening of the formed chamber 42. The adjustment of insert 20 can be accomplished by utilizing simple tools which actuate the relevant fasteners and simple metal cutting tools, such as a tin snips, which can be supplied with the insert kit.

As is apparent, insert 20 offers an easy retrofit arrangement that increases the oxidation of the gases generated in an existing fireplace structure to increase the amount of combustion gases that are safe for room ventilation. Additionally, if the catalyst adequately accomplishes the oxidation of the combustion gases, it is possible that the flue may be able to be closed during operation of the fireplace, thus ensuring the recirculation of larger quantities of warm gases into the interior of the room, and further, eliminating the possibility of cold drafts entering through the flue pipe. Further, insert 20 can be used to further decrease the amount of harmful gases generated in a clean-burning fireplace unit.

From the foregoing, it will be seen that this invention is one well-adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

I claim:

1. A catalytic insert for an existing fireplace structure, the fireplace structure including a top wall, a bottom wall, a rear wall, and a pair of side walls, the insert comprising:

a frame carrying a catalyst member and adjustable to conform to multiple configurations of said fireplace structure, said frame being disposed in the fireplace structure at a vertically elevated position such that an upper chamber is formed in the structure, and such that at least a portion of the combustion products generated in the fireplace flow into the chamber through said catalyst member and exit the chamber into a room in which the fireplace structure is located; and at least one support member extending from said frame to the fireplace structure bottom wall, said support member providing the main source of support of said frame within the fireplace structure, said frame and support adapted to be positionable in an existing fireplace structure to allow catalytic reaction of combustion products generated in the fireplace structure.

2. The fireplace insert of claim 1 wherein said frame includes at least two elongated edge segments, said edge segments having at least one joint between them, said joint allowing movement of one edge segment with respect to the other to adjust the frame.

3. The fireplace insert of claim 2 wherein said joint includes a deformable piece of material that extends between said edge segments.

4. The fireplace insert of claim 2 wherein at least one of said edge segments is adjustable in length.

5. The fireplace insert of claim 4 wherein said adjustable length edge segment includes two portions, wherein one of said portions is telescopically received in said other portion.

6. The fireplace insert of claim 1 wherein said support member is vertically adjustable.

7. The fireplace insert of claim 6 wherein said support member includes at least two portions, with one portion telescopically received in the other portion.

8. The fireplace insert of claim 1 wherein there are at least two support members.

9. The fireplace insert of claim 1 wherein said frame includes a panel with an aperture therein, said catalyst member disposed in conjunction with said aperture such that combustion products flow through said aperture and said catalyst member.

10. An adjustable fireplace insert for positioning at an elevated position in a fireplace, the insert comprising:

a plurality of elongated edge segments, at least two of said segments being connected together such that one of said connected segments can be angularly adjusted with respect to the other of said connected segment, at least one of said segments also being adjustable in length; and an adjustable catalyst support panel, said panel attached to said elongated edge segments and supporting a catalyst member.

11. The adjustable fireplace insert of claim 10 wherein said joint includes a deformable piece of material that extends between the connected segments.

12. The adjustable fireplace insert of claim 10 wherein said adjustable length edge segment includes two portions, wherein one of said portions is telescopically received in the other portion.

13. The adjustable fireplace insert of claim 10 comprising four edge segments adjustably joined together at their ends to form an adjustable parallelogram structure, each of said edge segments also being adjustable in length.

14. The adjustable fireplace insert of claim 13 wherein each edge segment includes two portions, wherein one of said portions is telescopically received in the other portion.

15. The adjustable fireplace insert of claim 14 wherein each adjustable joint between adjacent edge segments includes a deformable piece of material that extends between the segments.

16. An adjustable fireplace insert for positioning at an elevated location in a fireplace, the insert comprising:

four elongated edge support members, each support member having a deformable joint formed at a location intermediate the ends of the member so as to divide each member into two sections, said deformable joint allowing movement of one section of the support member with respect to the other section so that the support member can conform to the comer of a fireplace, and wherein two of said support members are of generally larger cross-sectional size than the other two members so that each of the sections of the large support members can telescopically receive a section of the smaller support members to form a parallelogram structure that can be expanded or contracted to conform and adjust to an existing fireplace; and an adjustable catalyst support panel, said panel attached to said support members and supporting a catalyst member.

17. The adjustable fireplace insert of claim 16 further including at least one adjustable vertical support structure for adjusting the distance the catalyst member is elevated within the fireplace.

18. The adjustable fireplace insert of claim 17 wherein said support structure has two portions that are telescopically adjustable.

19. A catalytic insert for an existing fireplace structure, the fireplace structure including a top wall, a bottom wall, a rear wall, and a pair of side walls, the insert comprising:

a frame carrying a catalyst member, said frame being disposed in the fireplace structure at a vertically elevated position such that an upper chamber is formed in the structure, and such that at least a portion of the combustion products generated in the fireplace flow into the chamber through said catalyst member and exit the chamber into a room in which the fireplace structure is located;

at least one support member extending from said frame to the fireplace structure bottom wall, said support member providing the main source of support of said frame within the fireplace structure, said frame and support adapted to be positionable in an existing fireplace structure to allow catalytic reaction of combustion products generated in the fireplace structure; and a grate attached to said frame and generally covering a gap formed between a front portion of said frame and the fireplace structure top wall.

* * * * *